United States Patent [19]

Logsdon

[11] Patent Number: 4,525,273

[45] Date of Patent: Jun. 25, 1985

[54] DRAIN GRATE WITH ADJUSTABLE WEIRS

[76] Inventor: Duane D. Logsdon, 1708 Calavera Dr., Fullerton, Calif. 92631

[21] Appl. No.: 508,141

[22] Filed: Jun. 27, 1983

Related U.S. Application Data

[63] Continuation-in-part of Ser. No. 271,501, Jun. 8, 1981, abandoned.

[51] Int. Cl.[3] ..... E03F 5/06

[52] U.S. Cl. ..... 210/164; 210/166

[58] Field of Search ..... 210/163, 164, 165, 166

[56] References Cited

U.S. PATENT DOCUMENTS

| | | | |
|---|---|---|---|
| 1,674,347 | 6/1928 | Silverman | 210/166 X |
| 1,973,321 | 9/1934 | Schultz | 210/166 X |
| 2,666,493 | 1/1954 | Gordon | 210/166 X |
| 2,837,212 | 6/1958 | Schmid | 210/166 |
| 3,121,682 | 2/1964 | Alberico | 210/166 |
| 3,357,561 | 12/1967 | Schmid et al. | 210/163 |
| 3,469,669 | 9/1969 | Blendermann et al. | 210/166 |
| 3,469,698 | 9/1969 | Blendermann | 210/163 |
| 3,529,723 | 9/1970 | Hagedurn | 210/163 |
| 3,884,809 | 5/1975 | Logsdon | 210/163 |

*Primary Examiner*—Frank Spear

*Attorney, Agent, or Firm*—K. H. Boswell; Edward D. O'Brian

[57] ABSTRACT

A self supporting grate for a drain structure can be improved by including as part of the grate a mounting base sized and shaped to attach the grate to the drain structure. At least a portion of the grate is formed as a generally upwardly projecting wall attaching to and extending from the base. The wall includes a plurality of weirs capable of forming a variable flow fluid pathway to the interior of the grate for fluid disposal by the drain structure. The weirs are constructed so as to allow fluid at a first fluid level on the wall as measured from the base to flow at a first rate from the exterior of the grate into the interior grate and fluid at a second fluid level likewise measured along the wall from the base to flow at a second rate into the interior of the grate, with the second rate being different from the first rate. A guard lip is located on the mounting base peripheral to the grate to retard the flow of solid material over the guard lip and to prevent clogging of the grate. Holes may be provided in the base to allow smaller matter to pass through.

3 Claims, 3 Drawing Figures

DRAIN GRATE WITH ADJUSTABLE WEIRS

CROSS REFERENCE TO RELATED APPLICATIONS

This application is a continuation-in-part of my application Ser. No. 271,501 filed June 8, 1981, now abandoned, entitled "DRAIN GRATE WITH ADJUSTABLE WEIRS", the entire disclosure of which is herein incorporated by reference.

BACKGROUND OF THE INVENTION

This invention is directed to a self-supporting grate for a drain structure. The self-supporting grate is designed such that a variable fluid flow through the grate, depending on the height of the fluid to be discharged through the grate is achieved. The variable rate is achieved by the use of a plurality of weirs sized and shaped so as to allow for variable flow rate depending on the depth of the fluid to be removed. A guard lip is located exterior of the weirs and serves to prevent debris from clogging said weirs.

Most flat topped roofs of buildings, houses and the like, as well as other structures such as parking lots and the like, incorporate grated drain structures for removal of fluid, i.e., water, from the flat area. The grate is incorporated on the drain structure to prevent foreign bodies from being deposited into the drain structure and clogging the draining system and the like. Further, the grates are designed to keep vermin and other such pests from entering or exiting from the drain system.

There presently exist a number of drain structures as, for example, the structure described in my U.S. Pat. No. 3,884,809. In this drain structure, a scupper drain is equipped with a self-supporting dome covering the entrance to the portion of the drain which serves to divert fluid from the top of the drain through the drain and into the drain pipe. For use on flat roofed buildings and the like, this type of drain has been found very utilitarian in ease of installation, longevity of the product and prevention of entry of foreign matter into the drain system.

Certain geographical areas are subjected to weather patterns such that within a very short period of time a considerable amount of rainfall occurs resulting in the production of a sizable amount of standing water on structures, paved areas and the like. Since building roofs and the like and parking lots and the like are covered with material impervious to water penetration, the rainfall accumulates on these surfaces at depths depending on the collecting area of the surface as well as the amount of rainfall.

Because of the inability of storm drain systems to handle a large amount of water over a specific time period, heavy rainfall may completely overtax the capacity of the storm drain system. In order to combat the problem of either inadequate storm drain capacity of a municipality and/or excessive rainfall over a short period of time, it would be beneficial to have the individual drain structures on each and every building, parking lot or the like be able to govern the influx of run-off into the storm drain system such that the storm drain system could operate at full capacity, but would not be overtaxed or overburdened such that erratic water removal and/or damage to the storm drain system resulted.

Many of the grates utilized on existing drain structures are generally of the type illustrated in the above noted patent. The noted patent utilizes a drain having a foraminous grate. This grate is formed by including a plurality of equally sized slots or openings in the grate. These slots or openings extend from an area adjacent to where the grate fits onto the scupper drain structure and up to and including the crown or uppermost periphery of the grate. In other grates, such as flat grates, the openings would be evenly spaced over the surface of the grate. It is obvious that with this type of grate system there can be no specificity with regard to flow rate of the water or other fluid through the grate. It is also obvious that such grates are susceptible to being clogged by solid material carried to their foraminous portions by the liquid draining into the grates.

Grates may be exposed to a variety of materials which, if allowed to cover their foraminous surfaces, will cause them to clog and cease draining. These materials may include rocks, pebbles, twigs, leaves, paper, dirt, sand, grass, trash or other matter, depending on the grate location. Such a blockage will at best seriously slow down the time required to drain the roof or other surface and the weight of the accumulated water can seriously tax the support structure, possibly resulting in the formation of leaks or even total collapse of the structure.

In order to logically and efficiently remove large amounts of standing water on structures served by drains it is evident that new and improved grate structures must be developed. Further, in order to maintain economy of construction, new and improved grates are needed which are capable of having variable flow rates which can comply with local ordinances governing the flow rate of water input into a storm drain system. Further, these grates must not easily become clogged by debris being washed into them.

BRIEF DESCRIPTION OF THE INVENTION

In view of the above, it is recognized that there exists a need for new and improved grate structures. It is, therefore, a very broad object of this invention to provide such a grate structure which fulfills these needs. It is a further object of this invention to provide a grate structure formed of easily attainable and workable materials such that the grate structure as manufactured will be economical to the producer and can be installed with a minimum expenditure of valuable and expensive labor time. It is a further object to provide a grate structure which because of its construction will hold up to the wear and tear of being exposed to the elements as well as to any stresses placed upon it by other influences in the environment such as influx of traffic through the area where the grate structure is located. It is a further object to provide a grate structure which resists clogging.

These and other objects, as will be evident from the remainder of this specification are achieved in an improvement in a self supporting foraminous grate for a drain structure which comprises: said grate having an exterior and an interior, said exterior of said grate communicating with the ambient environment, said interior of said grate communicating with said drain structure such that fluid in the interior of said grate passes into said drain structure; a portion of said grate formed as a mounting base, said base sized and shaped to attach to said drain structure maintaining said grate on said drain structure; a portion of said grate formed as a generally upwardly projecting wall integrally formed with and extending upwardly from said base, said wall formed as a continuous surface of revolution; a portion of said grate formed as a top surface integrally formed on the uppermost periphery of said wall, said top surface including a plurality of openings in said top surface; a portion of said grate formed as a guard lip integrally formed with and extending upwardly from said base and culminating in a top edge, said guard lip retarding the flow of solid material towards said wall, said guard lip radially displaced outwardly from said wall; a plurality of weirs located in said wall forming a fluid passageway from the exterior of said grate into the interior of said grate; said weirs located in said wall in a symmetrical array around the surface of revolution of said wall, each of said weirs shaped as an elongated triangle with the base of each said triangle located proximal to said top surface and the apex of each of said triangles located proximal to said base so as to allow fluid at a first fluid level on said wall proximal to said base to flow at a first rate from the exterior of said grate into the interior of said grate and fluid at a second fluid level on said wall displaced upwardly from said base from said first fluid level to flow at a second rate which is greater than said first rate.

The guard lip may be formed as a wall contiguous with and rising up from the base located between the grate wall and the perimeter of the mounting base. The lip may be notched or otherwise configured to aid in preventing solid material from moving over the lip. Similarly the location of the guard lip in relation to the grate wall may be varied to aid in trapping debris before it can reach the grate wall.

In some applications where the grate may be exposed to material of a size which can easily pass through the grate and on through the associated drainage system. This may include sand or other fine particulate matter. The retention and accumulation of this matter by a guard lip may be disadvantageous if such accumulations facilitate the transport of larger material over the guard lip. This situation may be avoided by providing holes in the base of the grate outside of the guard lip to allow material capable of easily passing through the drain system to do so. The added texturing of the base provided by the holes also serves to counteract the tendency of water flowing over it to sweep material along.

The plurality of weirs extends into the wall from a location proximal to the base to a location distal from the base. As so constructed the weirs each comprise an opening in the grate between the exterior of the grate and the interior of the grate. The opening would have a first width at a first fluid level and a second width at a second fluid level and at least one intermediate width at a level intermediate the first and second fluid levels.

Preferredly, the weirs taper from a wide width at a point distal to the base to a narrow width at a point proximal to the base. It is preferable that at least a portion of the grate be shaped as a surface of revolution and the wall means forming at least a portion of this surface of revolution. Further, the surface of revolution can be truncated such that a top surface is formed. Such a top surface would be integrally formed with the uppermost periphery of the wall. This surface of revolution can be formed as any one of a conventional number of surfaces of revolutions such as cylinders, conics, spheres or the like. Preferredly, the lowest point in the notches in the guard lip will be at a higher elevation from the base than the lowest point in the weirs.

BRIEF DESCRIPTION OF THE DRAWINGS

The invention described in this specification will be better understood with reference to the drawings wherein.

Figure 1:
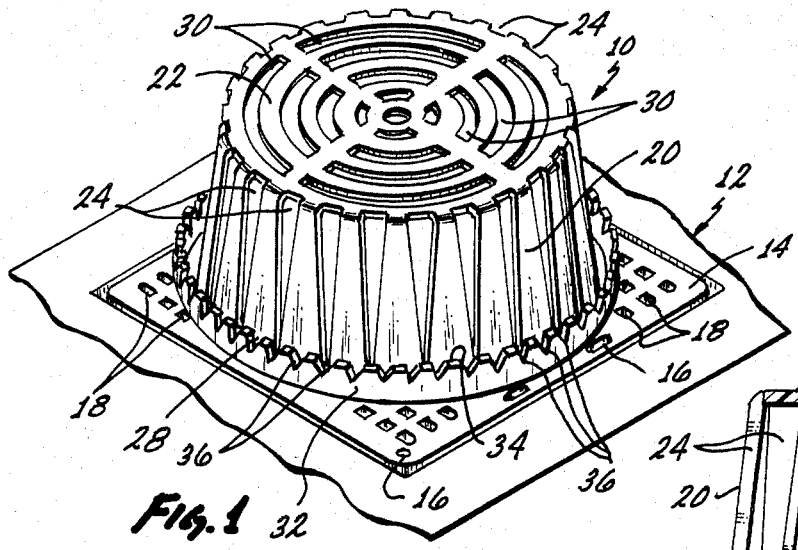
FIG. 1 is an isometric view of the invention.
Figure 3:
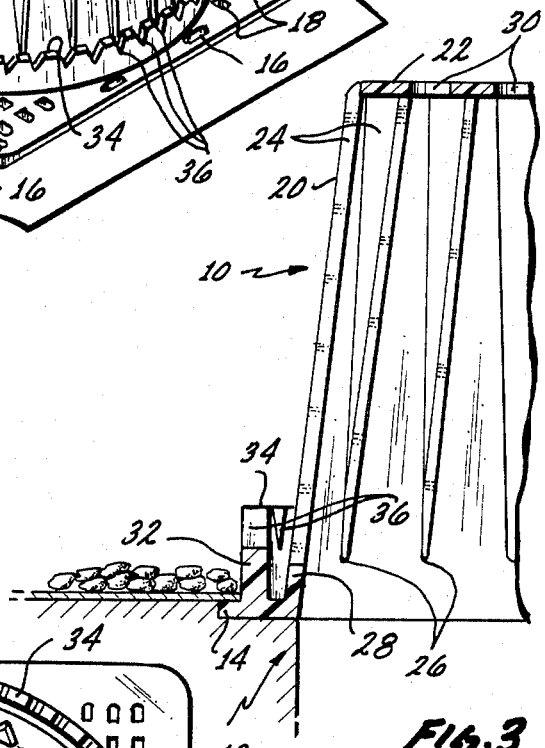
FIG. 3 is a side view in section about 3—3 of FIG. 2.

This invention utilizes certain principles and/or concepts as are set forth in the claims appended to this specification. Those skilled in the plumbing arts will realize that these principles and/or concepts are capable of being expressed in a number of embodiments differing from the illustrated embodiments described in this specification and shown in the drawings. For this reason, this invention is to be construed only in light of the claims and is not to be construed as being limited to the exact embodiments used herein for illustrative purposes only.

DETAILED DESCRIPTION

In FIG. 1 there is shown an embodiment of a grate 10 fitting on a portion of a drain structure 12. The drain structure 12 can be any one of a number of similar drain structures such as that described in my U.S. Pat. No. 3,884,809, the entire disclosure of which is herein incorporated. This type of drain has a recessed area in it which accepts the base portion 14 of the grate 10.

The base portion 14 of the grate 10 would include one or more holes collectively identified by the numeral 16 allowing for convenient attachment of the grate 10 to the drain 12. Appropriate screws or the like are simply passed through the holes 16 and screwed into the drain structure 12. Preferredly, the base portion 14 is square of rectangular in shape such that it can easily and conveniently be located into a square or rectangular shaped depression within the drain structure 12. A plurality of percolator holes collectively identified by the numeral 18 are also provided in the base 14. These percolator holes serve to remove the last remaining portion of water which has been deposited on the drain structure 12. The percolator holes 18 are sized and shaped such that only material which can be easily carried through the drain system can pass through. The percolator holes 18 are designed to only handle limited amounts of fluid flow, i.e., water removal from the structure which is being served by the drain structure 12. As is described in my above noted patent, the drain 12 would incorporate a suitable collecting basin immediately below the base 14 portion of the grate 10.

Figure 2:
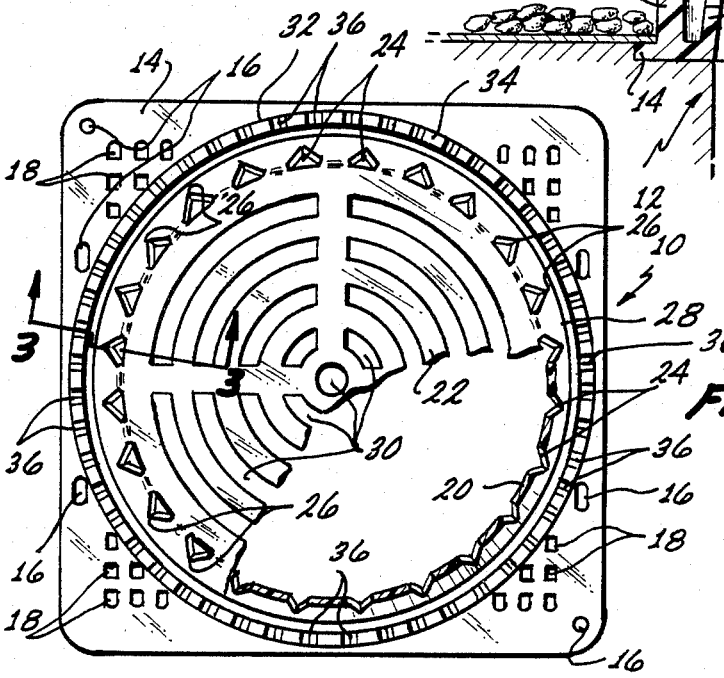
FIG. 2 is a top plan view in partial section of the grate of FIG. 1.

Projecting upwardly from the base 14 as seen in FIGS. 1 and 2 is a truncated conical shaped section. Formed as a part of this section is a wall 20 and a top 22. The wall 20 and the top 22 are integrally formed with the base 14 preferredly by a suitable molding technique. Normally, the grate 10 and other grates as herein described would be formed of a high impact ABS plastic with an acrylic surface for ultraviolet protection. Such material has been found to be very resistant to the weather and elements. Additionally, it is lightweight and easy to store and handle.

Symmetrically spaced around the wall 20 are a plurality of weirs collectively identified by the numeral 24. As can be seen in FIGS. 1 and 2 the weirs 24 are shaped as upsidedown elongated isosceles triangles. The apex 26 formed by the smallest angle of these isosceles triangles is pointed toward the base, that is it is proximal to the base, with the base of the isosceles triangle located near the junction of the wall 20 and the top 22 distal from the base 14.

The area 28 of the wall 20 between the apex 26 and the base 14 constitutes an imperforate area not subject to fluid passage therethrough.

A guard lip 32 integrally formed with and extending upwardly from the base 14 is radially located out from the wall 20. The lip 32 has a top edge 34. The top edge 34 of the guard lip 32 includes a plurality of notches 36. The notches 36 are preferredly of a V-shape.

The depth of water accumulating before first flow into the drain 12 is controlled by both the height above the base 14 of the apex 26 of the weirs 24 and the height of the bottom of the notched 36 in the guard lip 32. Once the water level is greater than the height of the guard lip 32 the rate of flow through the weirs 24 is determined by the height of the water relative to the apex 26.

The guard lip 32 serves primarily to prevent debris from reaching the grate 10. The lowest part of the notches 36 in the guard lip 32 is higher than the apex 26 in the weirs 24. Fluid flow through the weirs 24 does not commence until the water level reaches the lowest part of the notches 36. This allows the guard lip 32 to regulate the depth of water which accumulates before draining through the weirs 24.

Depending on the depth of the water above the apex 26, the water will be exposed to openings having a varying area governed by that portion of the weirs 24 which are below the depth of the water. Because of the shape of the weirs 24 and the area increase of their openings as the opening extend from the base 24 toward the top 22, the flow rate of water or other fluid through the weirs 24 will be dependent upon the depth of this water above the apex 26. Flow rate through only the apex 26 portion of the weir will be quite slow and will be at a first rate whereas flow rate when the water is at a height almost to the top 22 will be sufficiently greater at a second rate.

The top 22 includes a plurality of openings collectively identified by the numerals 30 which serve to allow for fluid flow through the grate 10 into the storm sewer if and when the height of water above the apex 26 exceeds the height of the wall 20. This serves to prevent large accumulations of water on the roofs of structures, which might exceed their structural capacity and the like. However, an amount of rainfall necessary to exceed the height of the wall 20 is considered to be out of the ordinary and normally discharge of water through the grate 10 will be achieved through the weirs 24 augmented by the percolator holes 18. In the embodiments shown in FIGS. 1 and 2 the weirs 24 are of a fixed size and shape and are suitable for standardization to any codes by manufacturing according to such standarization.

I claim:

1. In a self supporting foraminous grate for a drain structure an improvement which comprises:

said grate having an exterior and an interior, said exterior of said grate communicating with the ambient environment, said interior of said grate communicating with said drain structure such that fluid in the interior of said grate passes into said drain structure;

a portion of said grate formed as a mounting base, said base sized and shaped to attach to said drain structure maintaining said grate on said drain structure;

a portion of said grate formed as a generally upwardly projecting wall integrally formed with and extending upwardly from said base, said wall formed as a continuous surface of revolution;

a portion of said grate formed as a top surface integrally formed on the uppermost periphery of said wall, said top surface including a plurality of openings in said top surface;

a portion of said grate formed as a guard lip integrally formed with and extending upwardly from said base and culminating in a top edge, said guard lip retarding the flow of solid material towards said wall, said guard lip radially displaced outwardly from wall;

a plurality of weirs located in said wall forming a fluid passageway from the exterior of said grate into the interior of said grate;

said weirs located in said wall in a symmetrical array around the surface of revolution of said wall, each of said weirs shaped as an elongated triangle with the base of each said triangle located proximal to said top surface and the apex of each of said triangles located proximal to said base so as to allow fluid at a first fluid level on said wall proximal to said base to flow at a first rate from the exterior of said grate into the interior of said grate and fluid at a second fluid level on said wall displaced upwardly from said base from said first fluid level to flow at a second rate which is greater than said first rate;

said wall includes a fluid imperforate area located on said wall and extending between said base and the apex of each of said triangular shaped weirs, said imperforate area forming a dam wall between the exterior of said grate and the interior of said grate inhibiting fluid flow into the interior of said grate;

said guard lip is continuous around said wall;

said top edge of said guard lip including a plurality of notches located therein;

said top edge of said guard lip is located at a height greater than said apex of each of said triangular shaped weirs;

said notches in said guard lip are V-shaped and the lowest most portion of said notches are of a greater elevation from said base than is said apex of each of said weirs.

2. The grate of claim 1 wherein:

said base further includes a plurality of holes located in said base peripheral to said guard lip.

3. The grate of claim 2 wherein:

said holes are of a size which selectively allows passage of matter which can be flushed through said drain structure without blocking said drain structure.

* * * * *